United States Patent [19]

Wantuch

[11] Patent Number: 4,527,134

[45] Date of Patent: Jul. 2, 1985

[54] RECIPROCAL RF SWITCH

[75] Inventor: Ernest Wantuch, Fort Lee, N.J.

[73] Assignee: Premier Microwave Corp., Port Chester, N.Y.

[21] Appl. No.: 529,948

[22] Filed: Sep. 7, 1983

[51] Int. Cl.[3] ..... H01P 1/11

[52] U.S. Cl. ..... 333/1.1; 333/102

[58] Field of Search ..... 333/1.1, 102

[56] References Cited

U.S. PATENT DOCUMENTS 2,848,714 8/1958 Ring ..... 333/1.1 UX
3,070,760 12/1962 Wheeler ..... 333/1.1
3,305,797 2/1967 Clavin ..... 333/1.1
3,324,418 6/1967 Caswell ..... 333/1.1

OTHER PUBLICATIONS

Helszajn, *Nonreciprocal Microwave Functions and Circulators*, John Wiley & Sons, New York, 1975, title page and pp. 2 and 5 cited.

*Primary Examiner*—Paul Gensler
*Attorney, Agent, or Firm*—Brumbaugh, Graves, Donohue & Raymond

[57] ABSTRACT

Single-pole, multi-throw reciprocal RF switches are arranged using fixed and switchable three-port and four-port non-reciprocal circulators.

13 Claims, 8 Drawing Figures

RECIPROCAL RF SWITCH

BACKGROUND OF THE INVENTION

This invention relates to RF switching devices, and particularly to switching devices which use non-reciprocal components, such as three and four port circulators in combination with switchable three and four port circulators, hereafter referred to as three and four port switches, respectively. The purpose of combining such building blocks is to effect the connection of an input terminal to one of several output terminals in a reciprocal manner.

FIGS. 1 and 2 illustrate two types of known ferrite switches in schematic form. FIG. 1 illustrates a three-port switch, which includes a ferrite element interacting with the RF (microwave magnetic) field and results in non-reciprocal switching of an input signal at port P1, to either of two output ports, labelled P2 and P3, respectively. Three port switches of the type shown in FIG. 1 may be constructed using waveguide junctions with the ferrite element located near the center of the junction, or they may be constructed using any transmission line junction, such as coaxial lines, stripline, or microstrip. The ferrite element is magnetically biased by a permanent magnet in the circulator version, whereas in the switch version the internal magnetic flux direction is reversed by an external electromagnet, or a closed loop magnetic geometry may be left in either remanent magnetic state of its major or minor hysteresis loop. These two states of internal magnetic flux orientation will result in two switch states when the ferrite is placed in the microwave junction.

In a junction circulator the interaction between the magnetized ferrite and the microwave (R.F.) magnetic field may be viewed as a differential permeability interacting with two counter-rotating microwave magnetic fields, into which a linearly polarized R.F. magnetic field may be resolved. In a four port switch, the R.F. magnetic field in rectangular waveguide may be considered as locally circularly polarized, thus removing the degeneracy, a requirement of non-reciprocal interaction in the microwave circulator or switch. FIG. 2 schematically illustrates the four port device function based on the theory outlined above. The ports of the four port circulator or switch include ports on opposite sides of the schematic diagram of the four port device, which are decoupled, or isolated, from each other. Thus, in the four port device shown in FIG. 2, ports P1 and P3 are decoupled, and ports P2 and P4 are decoupled, from each other. Remaining pairs of ports are non-reciprocally coupled to each other.

The four port circulator or switch can be implemented by a pair of hybrid junctions, such as a magic tee and sidewall hybrid pair in waveguide, or ring hybrid and junction hybrids in TEM configurations. Between such pairs of hybrid junctions, sections of transmission line are loaded with ferrite configurations and/or diectric configurations so that non-reciprocal interaction between the R.F. magnetic field and the internal magnetic flux of the ferrite may occur. This arrangment results in differential phase shift which, in turn, in combination with the hybrid junction, results in non-reciprocal port connection described schematically above. Those skilled in the art will recognize that four port configurations can be obtained by combining two three port devices. When a four port switch is used to connect one transmitter and one receiver to two antennas, alternately, such operation may be undesirable in certain system applications. For antennas which are stationary or only movable over a limited angular range, two transmission lines may be used to their respective antennas. When such antennas are used in applications requiring greater angular coverage, a two-channel rotary joint is required. This may present a difficult design problem in high power systems. When the switch is placed past the rotary joint, the dual channel rotary joint needs to have only one high power and one low power channel. The insertion loss of the low power channel may be unacceptable from a system sensitivity viewpoint.

The above difficulties are compounded when more than two antennas are used. With a reciprocal ferrite switch, transmission and reception paths are identical so that the switch can be mounted between the multiple antennas and a single channel rotary joint. This arrangement is especially attractive in high frequency, high power systems, where multiple channel rotary joints are not feasible.

It has been known in the art to provide reciprocal switching, which avoids the need to switch between transmitter and receiver operation by providing a ferrite phase shifter operated switching arrangement, wherein the ferrite is switched between a neutral, reciprocal state and a second state which provides all of the required phase differential (usually 180°) in a single channel. This results in a design with undesired high insertion loss, giving particular problems in the high power applications.

It is an object of the present invention to provide a reciprocal RF switch for selectively and reciprocally connecting an input terminal to a selected one of a plurality of output terminals using non-reciprocal components.

SUMMARY OF THE INVENTION

In accordance with the invention there is provided a reciprocal RF switch having an input terminal and at least first and second output terminals. The switch includes a first circulator having a first port connected to the input terminal and having a second port and another port, both non-reciprocally coupled to the first port. The switch also includes a second, four-port circulator having a first port connected to the second port of the first circular, a second port connected to the first output terminal, a fourth port connected to the second output terminal, and a third port, isolated from the first port and connected to the other port of the first circulator. There is also provided means, responsive to a supplied control signal, for switching one of the circulators.

The switching means can switch either the first or the second circulator. The circulator which is not switched can be a fixed circulator. The first circulator can be either a three-port circulator or a four-port circulator. Where the first circulator is a four-port circulator, the third port of the circulator is preferably terminated. The four-port first circulator is preferably used in high power switching applications.

In accordance with the invention there is provided a reciprocal RF switch having an input terminal and a plurality of output terminals. The switch includes first non-reciprocal circulator means having a first port connected to the input terminal and at least two other ports. The switch includes second non-reciprocal circulator means, including circulator ports connected to the two other ports and circulator ports connected to the output terminals. Finally the switch includes means for selectively switching at least one of the first and second circulator means to couple signals supplied to the input terminal to a selected one of the output terminals and to coupled signals supplied to the selected output terminal to the input terminal.

In one embodiment of the invention there is provided a reciprocal RF switch having an input terminal and at least three output terminals. This configuration includes four circulator means interconnecting the input and output terminals, and means for switching at least some of the circulators to provide reciprocal RF coupling between the input terminal and a selected one of the output terminals.

In accordance with another embodiment of the invention there is provided a reciprocal RF switch having an input terminal and at least four output terminals. This embodiment includes five circulators which are interconnected and controlled by switching means to couple signals from the input port to a selected one of the output ports and to couple signals supplied to the selected output port to the input port.

For a better understanding of the present invention, together with other and further objects, reference is made to the following description, taken in conjunction with the accompanying drawings, and its scope will be pointed out in the appended claims.

DESCRIPTION OF THE INVENTION

Figure 3:
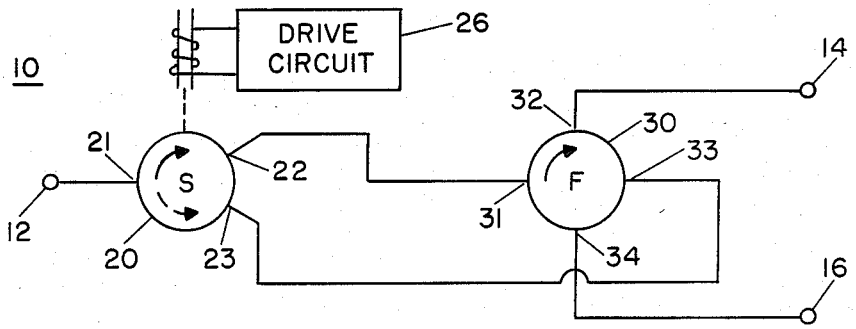
FIG. 3 is a schematic illustration of a single-pole, double-throw reciprocal RF switch in accordance with the present invention.

FIG. 3 is a schematic illustration of a single-pole, double-throw reciprocal RF switch 10 in accordance with the present invention. Switch 10 illustrated in FIG. 3 has an input terminal 12 and two output terminals 14 and 16. Since the switch is intended to provide reciprocal switching between the input terminal 12 and the output terminals 14 and 16, the use of the term "input terminal" and "output terminal" should be understood to be used only in connection with the method of switching, and not with the direction of signal flow between the terminals. Thus, terminal 12 may be reciprocally interconnected with either terminal 14 or terminal 16 as a result of the switching operation of the switch 10 illustrated in FIG. 3. In FIG. 3 there are provided a first circulator 20 and a second circulator 30. In the embodiment illustrated, the first circulator is a switchable three-port circulator, which has a first port 21 connected to input terminal 12, a second port 22 connected to a first port 31 of second circulator 30, and a third port 23 connected to third port 33 of second circulator 30. Second circulator 30 is a fixed four-port circulator. In the schematic diagrams the term S or F within each circulator indicates whether that circulator is a switched circulator or a fixed circulator.

Second, four-port circulator 30 has its first and third ports 31, 33 connected to first circulator 20, and has its second and fourth ports 32 and 34 connected to output terminals 14 and 16 respectively. Drive circuit 26 responds to supplied control signals to change the magnetic field applied to switchable circulator 20 and provided reciprocal switching of signals between input terminal 12 and one of output terminals 14 and 16, as will be described.

In operation, if first circulator 20 is in a first state, indicated by the solid arrow, signals supplied to input terminal 12 are coupled from first port 21 to second port 22 of circulator 20. The signals are likewise coupled from first port 31 to second port 32 of four-port circulator 30, from which they are supplied to first output terminal 14. Signals supplied from first output terminal 14 to second port 32 of second four-port circulator 40 are provided to third port 33 of second four-port circulator 30, and thence to third port 23 of first circulator 20. The signals are then coupled from third port 23 of circulator 20 to first port 21 of circulator 20 and thence to the input terminal 12. Thus, when circulator 20 is in the first state there is reciprocal coupling between input terminal 12 and output terminal 14 through two different paths.

When first circulator 20 is switched to its second state, indicated by the dotted arrow, by drive circuit 26, signals supplied to input terminal 12 are coupled from first port 21 of circulator 20 to third port 23 of circulator 20. The signals from third port 23 of circulator 20 are supplied to third port 33 of circulator 30, and thence coupled to fourth port 34 of circulator 30, and to second output terminal 16. When signals are supplied to output terminal 16, they are coupled from the fourth port 34 of circulator 30 to first port 31 of circulator 30, thence to second port 22 of circulator 20, and to first port 21 of circulator 20 to input terminal 12. Accordingly, when drive circuit 26 switches circulator 20 to its second state, there is provided reciprocal paths between input terminal 12 and second output terminal 16.

Figure 1:
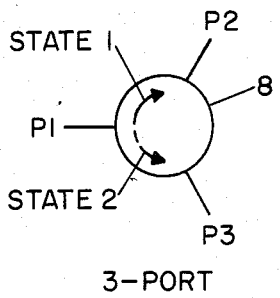
FIG. 1 (PRIOR ART)
FIG. 1 is a schematic illustration of a prior art three-port circulator.
Figure 2:
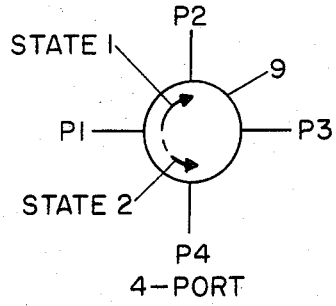
FIG. 2 (PRIOR ART)
FIG. 2 is a schematic illustration of a prior art four-port circulator.
Figure 4:
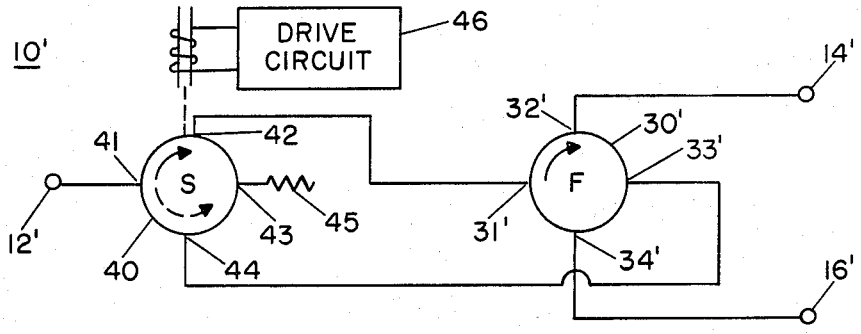
FIG. 4 is a schematic illustration of another single-pole, double-throw reciprocal RF switch in accordance with the present invention.

FIG. 4 is a schematic illustration of a reciprocal RF switch 10', which is similar to the switch 10 illustrated in FIG. 3, except that instead of using a three-port circulator 20 as the first circulator, a four-port circulator 40 is provided as the first circulator. The second circulator 30' and its respective ports 31', 32', 33' and 34' are connected in a manner similar to the circulator 30 of the switch 10 illustrated in FIG. 3. In the FIG. 4 illustration, the first and second output terminals are numbered 14' and 16'. Four-port circulator 40 has its first port 41 connected input terminal 12', its second port 42 connected to first port 31' of circulator 30', its third port 43 connected to a resistive termination 45, and its fourth port 44 connected to the third port 33' of second circulator 30'. The operation of the RF switch 10' illustrated in FIG. 3 is basically identical to the RF switch 10 illustrated in FIG. 1. It should be noted that the third port 43 of circulator 40 is the port which is reciprocally isolated from the first port 41.

The replacement of the three-port circulator 20 used in RF switch 10 with a four-port circulator 40 as shown in the RF switch 10' of FIG. 4, is a capability which can be implemented in all of the configurations of the present invention. The four-port circulator may be desirable for use in connection with a switch where the switch must handle high peak or average power, since such four-port devices can generally be configured with a higher power capability than three-port devices. In some configurations it may only be necessary to use four-port circulators for components subjected to transmitter power levels.

Figure 5:
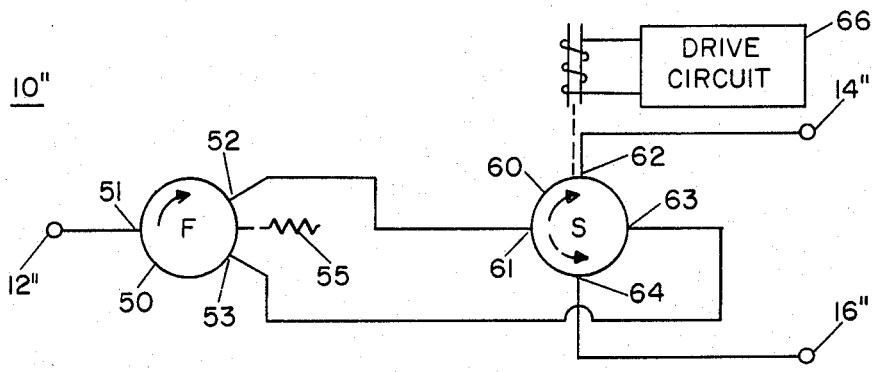
FIG. 5 is a schematic illustration of another single-pole, double-throw reciprocal RF switch in accordance with the present invention.

FIG. 5 is a schematic illustration of another embodiment of a single-pole, double-throw switch 10'' in accordance with the present invention. In the arrangement shown in FIG. 5 the RF switch 10'' includes a first circulator 50, which is a fixed circulator having three ports 51, 52 and 53. The second circulator 60 is a four-port circulator, which is switchable between first and second states. The input terminal 12'' is connected to first port 51 of first circulator 50. Second port 52 of first circulator 50 is connected to the first port 61 of second circulator 60. Third port 53 of the first circulator 50 is connected to the third port 63 of the second circulator 60. The second and fourth ports 62 and 64 of the second circulator 60 are connected respectively to first and second output terminals 14'' and 16''. A drive circuit 66 is magnetically coupled to switch second circulators 60 between its first and second states.

When second circulator 60 is in its first state, signals supplied to input terminal 12'' will be coupled through first circulator ports 51, 52, second circulator ports 61, 62 to first output terminal 14''. Signals from first output terminal 14'' will be coupled via second circulator ports 62, 63, first circulator ports 53, 51 to input terminal 12''. When second circulator 60 is in its second state, signals from input terminal 12'' will be coupled via first circulator ports 51, 52 and second circulator ports 61, 64 to second output terminal 16''. Signals from second output terminal 16'' will be coupled via second circulator ports 64, 63, and first circulator ports 53, 51 to input terminal 12''. There is thus provided reciprocal switching between input terminal 12'' and one of output terminals 14'' or 16''.

As previously mentioned, the first circulator 50 may also be a four-port circulator, in which case the third port would be connected to a resistive termination 55 and the fourth port would be connected to the third port 63 of second circulator 60, in a manner similar to the arrangement shown in FIG. 4.

Figure 6:
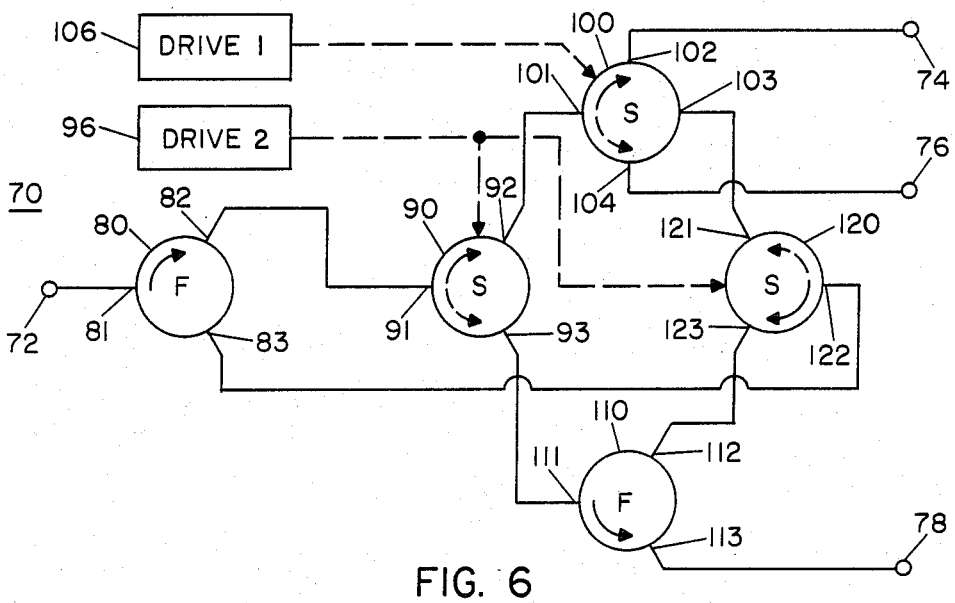
FIG. 6 is a schematic illustration of a single-pole, three-throw reciprocal RF switch in accordance with the present invention.
Figure 7:
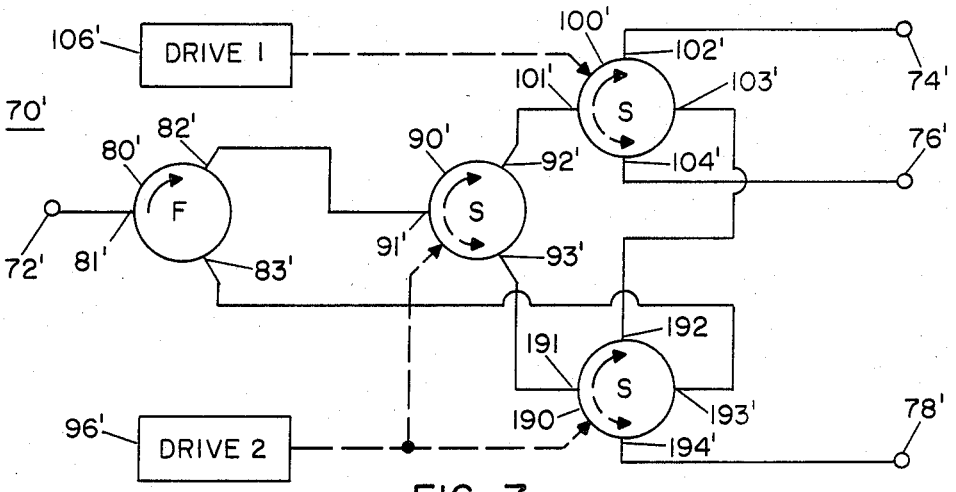
FIG. 7 is a schematic illustration of another single-pole, three-throw reciprocal RF switch in accordance with the present invention.

FIGS. 6 and 7 are schematic illustrations of two embodiments of single-pole, three-throw reciprocal RF switches in accordance with the present invention. Referring first to the switch 70 illustrated in FIG. 6, there is provided an input terminal 72 and first, second and third output terminals 74, 76 and 78. Input terminal 72 is connected to a first port 81 of a first circulator 80, which in the illustrated embodiment is a fixed three-port circulator. As previously noted, this could also be a four-port circulator with the appropriate connections. Output terminals 74 and 76 are connected to the second and fourth ports 102, 104, respectively, of a second four-port circulator 100. The first port 101 of circulator 100 is connected to the second port 92 of a third circulator 90. Third circulator 90 has its first port 91 connected to the second port 82 of first circulator 80. Circulators 120 and 110 collectively comprise a fourth circulator means. In the embodiment of FIG. 6, the fourth circulator means includes fourth circulator 120 and fifth circulator 110, both of which are three-port circulators. In the embodiment of an RF switch 70' illustrated in FIG. 7, the fourth circulator means is a single four-port circulator 190. In the RF switch 70, shown in FIG. 6, the third port 103 of second circulator 100, which is isolated from first port 101, is connected to the first port 121 of fourth three-port circulator 120. Circulator 120 has its second port 122 connected to the third port 83 of first circulator 80 and its third port 123 connected to the second port 112 of fifth three-port circulator 110. Fifth circulator 110 has its first port 111 connected to the third port 93 of third circulator 90. Fifth circulator 110 has its third port 113 connected to third output terminal 78. In the embodiment illustrated, the first and fifth circulators 80, 110 are three-port fixed circulators. The third and fourth circulators 90, 120 are three-port switchable circulators, and the second circulator 100 is a four-port switchable circulator. In order to provide switching among the three output terminals 74, 76 and 78 it is possible to drive the three switchable circulators 100, 90 and 120 using two drive circuits 96 and 106 as illustrated. Naturally individual drives can also be used. Second drive circuit 96 operates third circulator 90 and fourth circulator 120, to switch between first and second states. In the second state there will be reciprocal RF coupling between input terminal 72 and third output terminal 78. In the first state of drive circuit 96, there will be reciprocal RF coupling between input terminal 72 and either first or second output terminal 74 or 76, depending on the condition of first driver circuit 106. First driver circuit 106 operates switchable circulator 100 to be in the first state to provide reciprocal coupling between input terminal 72 and first ouput terminal 74, or to be in the second state, to provide reciprocal RF coupling between input terminal 72 and second output terminal 76.

In the reciprocal RF switch 70' shown in FIG. 7, many of the components provided are the same as the comparably numbered components used in connection with the switch 70 of FIG. 6, except that primes have been added to designate the components in switch 70'. In switch 70' a four-port switchable fourth circulator 190 is provided to replace the two three-port circulators 120 and 110 which are the fourth circulator means in the switch 70 of FIG. 6. Circulator 190 is a four-port switchable circulator having a first port 191 connected to the third port 93' of third circulator 90'. The second port 192 of circulator 190 is connected to the third port 103' of second circulator 100'. The third port 193 of circulator 190 is connected to the third port 83' of first circulator 80'. The fourth port 194 of circulator 190 is connected to the third output terminal 78'. Driver 96' drives switchable circulators 90' and 190 together in a manner similar to the use of the drive circuit 96 in the embodiment illustrated in FIG. 6. The two embodiments of three-throw switches 70 and 70' illustrate the alternate use of two three-port circulators or a single four-port circulator.

Figure 8:
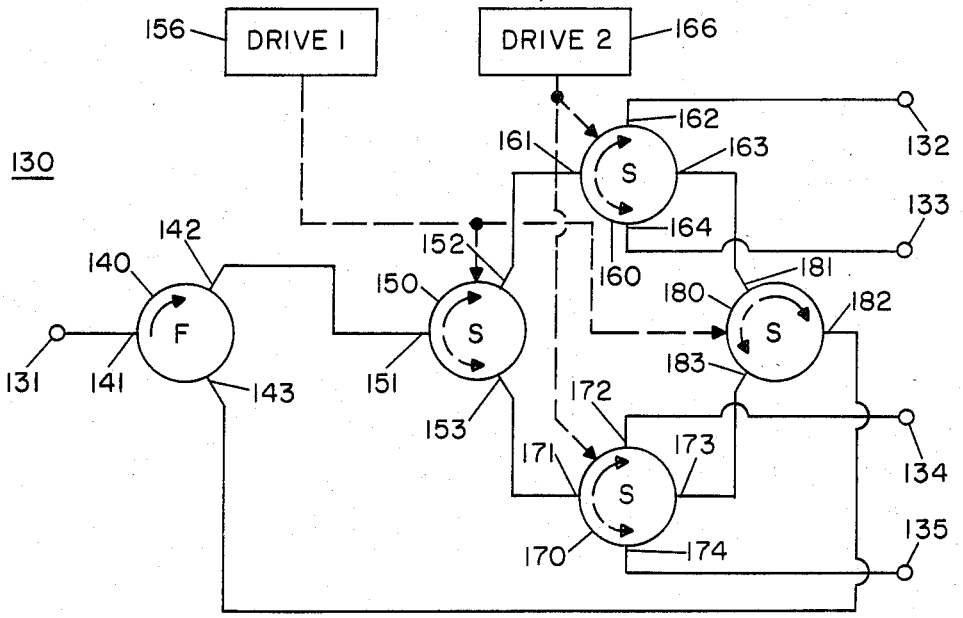
FIG. 8 is a schematic illustration of a single-pole, four-throw reciprocal RF switch in accordance with the present invention.

FIG. 8 is a schematic diagram illustrating a single-pole, four-throw reciprocal RF switch 130 in accordance with the present invention. Switch 130 includes a first three-port fixed circulator 140, which is connected to input terminal 131 by its first port 141. The second port 142 of first circulator 140 is connected to the first port 151 of second three-port switchable circulator 150.

The second and third ports 152 and 153 of second circulator 150 are connected to the first ports 161 and 171 of third and fourth four-port circulators 160 and 170, respectively. Circulators 160 and 170 are switchable four-port circulators. Circulator 160 has second and fourth ports 162 and 164 connected to first and second output terminals 132 and 133, respectively. Likewise, circulator 170 has second and fourth ports 172 and 174 connected to third and fourth output terminals 134 and 135, respectively. Third port 163 of third circulator 160 is connected to first port 181 of fifth circulator 180, which is a switchable three-port circulator. The third port 183 of fifth circulator 180 is connected to the third port 173 of switchable four-port fourth circulator 170. The second port 182 of fifth circulator 180 is connected to the third port 143 of first circulator 140. A first drive circuit 156 drives second and fifth switchable three-port circulators 150 and 180. A second drive circuit 166 drives third and fourth four-port switchable circulators 160 and 170. When drive circuits 156 and 166 are in the first state, there is provided reciprocal coupling between input terminal 131 and first output terminal 132. When drive circuit 156 is in the first state and drive circuit 166 is in the second state, there is provided reciprocal coupling between input terminal 131 and second output terminal 133. When drive circuit 156 is in the second state and drive circuit 166 is in the first state, there is provided reciprocal RF coupling between input terminal 131 and third output terminal 134. And when both drive circuits 156, 166 are in the second state, there is provided reciprocal RF coupling between input terminal 131 and fourth output terminal 135. Those skilled in the art can trace the coupling paths through the circulators of RF switch 130 in the manner previously described.

While there have been described what are believed to be the preferred embodiments of the present invention, those skilled in the art will recognize that other and further modifications may be made thereto without departing from the spirit of the present invention. In particular, it has been pointed out that three-port circulators can generally replaced by four-port circulators, particularly for high power applications. Further, the specific arrangement of fixed and switchable circulators can be changed without changing the function of the circuits illustrated. For example, in the embodiments illustrated in FIGS. 6, 7 and 8, the first circulator can be made to be a switchable circulator, and other circulators, as appropriate, can be made fixed circulators.

I claim:

1. A reciprocal RF switch having an input terminal and at least first, second and third output terminals, comprising:

a first circulator having a first port connected to said input terminal, and having a second port and another port, both non-reciprocally coupled to said first port;

a second four-port circulator having a first port, a second port connected to said first output terminal, a fourth port connected to said second output terminal and a third port isolated from said first port;

a third circulator having a first port connected to said second port of said first circulator, a second port connected to said first port of said second circulator, and another port;

fourth circulator means having a first port connected to said other port of said third circulator, a second port connected to said third port of said second circulator, a third port connected to said other port of said first circulator and a fourth port connected to said third output terminal;

and means for selectively switching the direction of RF energy through at least some of said circulators to provide reciprocal RF paths between said input terminal and a selected one of said output terminals.

2. An RF switch as specified in claim 1 wherein said switching means switches said second and third circulators and said fourth circulator means.

3. An RF switch as specified in claim 1 wherein said fourth circulator means comprises a fourth four-port circulator.

4. An RF switch as specified in claim 3 wherein said switching means includes a first switching circuit having two states and switching said second circulator and a second switching circuit having two states and switching said third and fourth circulators.

5. An RF switch as specified in claim 1 wherein said first and third circulators are a three-port circulators and wherein said other ports of said first and third circulators are third ports.

6. An RF switch as specified in claim 1 wherein said first and third circulators are a four-port circulators and wherein said other ports are fourth ports, wherein said first and third circulators have third ports, isolated from said first ports, and wherein said third ports are connected to terminations.

7. An RF switch as specified in claim 1 wherein said fourth circulator means comprises a fourth and a fifth circulator, each having at least three ports, said fourth circulator having said second and third ports and another port and said fifth circulator having said first and fourth ports and another port, said other ports being interconnected.

8. An RF switch as specified in claim 7 wherein said switching means switches at least one of said fourth and fifth circulators.

9. A reciprocal RF switch having an input terminal and at least first, second, third and fourth output terminals, comprising:

a first circulator having a first port connected to said input terminal, and having a second port and another port, both non-reciprocally coupled to said first port;

a second circulator having a first port connected to said second port of said first circulator, having a second port and another port, both non-reciprocally coupled to said first port;

third and fourth four-port circulators each having a first port connected to one of said second and other ports of said second circulator, each having second and fourth ports connected to ones of said output terminals, and each having a third port, isolated from said first port;

a fifth circulator having first and third ports, each connected to one of said third ports of said third and fourth four-port circulators, and having a second port, non-reciprocally coupled to said first and third ports, and connected to said other port of said first circulator;

and means, responsive to supplied control signals, for selectively switching the direction of RF energy through said circulators to reciprocally connect said input terminal to a selected one of said output terminals.

10. An RF switch as specified in claim 9 wherein said switching means switches said second, third, fourth and fifth circulators and wherein said first circulator is a fixed circulator.

11. An RF switch as specified in claim 10 wherein said switching means includes a first switching circuit having two states and switching said second and fifth circulators, and a second switching circuit having two states and switching said third and fourth circulators.

12. An RF switch as specified in claim 9 wherein said first and second circulators are three-port circulators, and wherein said other ports are third ports.

13. An RF switch as specified in claim 9 wherein said first and second circulators are four-port circulators, wherein said other ports are fourth ports, wherein said first and second circulator have third ports, isolated from said first ports, and wherein said third ports are connected to terminations.

* * * * *